US010051949B2

(12) United States Patent
Satterfield

(10) Patent No.: US 10,051,949 B2
(45) Date of Patent: Aug. 21, 2018

(54) TOOL POUCH WITH SPRING HINGED CLOSURE

(71) Applicant: Rogue Innovative Tools, Inc., Medford, OR (US)

(72) Inventor: Joseph Allen Satterfield, Medford, OR (US)

(73) Assignee: Rogue Innovative Tools, Inc., Medford, OR (US)

( * ) Notice: Subject to any disclaimer, the term of this patent is extended or adjusted under 35 U.S.C. 154(b) by 0 days.

(21) Appl. No.: 15/178,183

(22) Filed: Jun. 9, 2016

(65) Prior Publication Data

US 2017/0095069 A1 Apr. 6, 2017

Related U.S. Application Data

(63) Continuation of application No. 14/450,619, filed on Aug. 4, 2014, now Pat. No. 9,427,067.

(60) Provisional application No. 61/985,857, filed on Apr. 29, 2014.

(51) Int. Cl.
*A45F 5/02* (2006.01)
*B25H 3/00* (2006.01)

(52) U.S. Cl.
CPC ..... *A45F 5/021* (2013.01); *B25H 3/00* (2013.01)

(58) Field of Classification Search
CPC ... Y10S 224/904; Y10S 150/90; B65D 33/02; B65D 33/30; Y10T 16/540295; A45C 13/04; A45C 13/06; A45F 5/00; A45F 5/02; A45F 3/005; A45F 5/022; A45F 5/021; A45F 2200/0575; E05D 11/10; E05D 11/1007; E05D 11/1014; E05D 11/1028; E05D 11/105; E05D 11/1064; E05D 11/1071; E05D 11/1078; E05D 11/1085; E05D 5/006; E05D 5/201; E05D 1/1035; E05D 11/08; E05D 11/081; E05D 11/082; E05D 11/084; E05D 2011/085; E05D 11/087; E05D 11/1042; E05D 2005/145; E05D 5/10; E05D 5/14; E05D 5/16
USPC ..... 224/660; 16/319, 321, 334, 335, 336, 16/337, 341, 342
See application file for complete search history.

(56) References Cited

U.S. PATENT DOCUMENTS

| | | | | |
|---|---|---|---|---|
| 1,925,487 A * | 9/1933 | Karron | A45C 13/04 150/107 |
| 2,040,271 A | 5/1936 | Rosenzweig | |
| 2,142,904 A * | 1/1939 | Lamarthe | A45C 13/06 24/30.5 R |
| 3,145,748 A * | 8/1964 | Leonardi | A45C 13/04 150/123 |
| D254,759 S | 4/1980 | Rodstein | |
| 5,067,643 A | 11/1991 | McKinney | |
| D344,630 S | 3/1994 | Doerksen | |

(Continued)

FOREIGN PATENT DOCUMENTS

WO 1998/003461 A1 5/1988

*Primary Examiner* — Adam Waggenspack
(74) *Attorney, Agent, or Firm* — Scheinberg & Associates, PC; Michael O. Scheinberg

(57) ABSTRACT

A tool pouch, utility pouch, or the like, used on traditional tool belts with spring hinged closure device in the open position forces the mouth of the tool pouch into a fully open position creating greater access to the contents of the tool pouch. When the mouth of the tool pouch is pressed into a closed position, it secures the content of the tool pouch therein.

20 Claims, 17 Drawing Sheets

(56) References Cited

U.S. PATENT DOCUMENTS

| | | | |
|---|---|---|---|
| 5,609,419 | A | 3/1997 | Byers, Jr. |
| 5,639,003 | A | 6/1997 | Utzinger, III |
| 5,649,623 | A | 7/1997 | Kornblatt |
| 5,680,026 | A | 10/1997 | Lueschen |
| 5,743,451 | A | 4/1998 | Kahn |
| 5,813,530 | A | 9/1998 | Kornblatt |
| 5,988,315 | A | 11/1999 | Crane |
| 6,390,348 | B1 | 5/2002 | Godshaw |
| 6,435,389 | B1 | 8/2002 | Sucher |
| D482,524 | S | 11/2003 | Cabrera |
| 6,701,534 | B2 | 3/2004 | Guibord |
| 6,848,605 | B2 | 2/2005 | Dillenberger |
| 7,011,241 | B2 | 3/2006 | Godshaw |
| 8,028,872 | B2 | 10/2011 | Hamlin |
| D658,852 | S | 5/2012 | McCoy |
| 8,220,683 | B2 | 7/2012 | Williams |
| 8,919,629 | B2 | 12/2014 | Moreau |
| 8,991,672 | B2 | 3/2015 | Hassler |
| 9,427,067 | B2 | 8/2016 | Satterfield |
| 2004/0178240 | A1 | 9/2004 | Bauer |
| 2006/0102674 | A1 | 5/2006 | Godshaw |
| 2007/0006367 | A1 | 1/2007 | Newman |
| 2008/0023515 | A1 | 1/2008 | Coonan |
| 2008/0185414 | A1 | 8/2008 | Conlon |
| 2009/0145789 | A1 | 6/2009 | Panosian |
| 2012/0138623 | A1 | 6/2012 | Verna |
| 2013/0008933 | A1 | 1/2013 | Clifford |
| 2014/0161371 | A1 | 6/2014 | Moreau |
| 2014/0353352 | A1 | 12/2014 | Shapiro |
| 2016/0029774 | A1 | 2/2016 | Satterfield |

* cited by examiner

TOOL POUCH WITH SPRING HINGED CLOSURE

CROSS-REFERENCE TO RELATED APPLICATIONS

This is a continuation in part of U.S. patent application Ser. No. 14/450,619 filed Aug. 4, 2014, which application claims the benefit of U.S. Provisional App. No. 61/985,857, filed Apr. 29, 2014.

TECHNICAL FIELD

The present disclosure relates generally to a tool pouch, utility pouch, and the like used on tool belts, specifically to a tool pouch with a readily installable and removable detent spring hinged closure feature, providing a structure to force the pouch into a fully open and fully closed position.

BACKGROUND OF THE INVENTION

Construction workers, tradesmen, and the like typically use a tool belt attached about their waist to transport to and maintain tools and supplies at a worksite. Such belts are often fabricated from leather and include a number of tool pouches which are designed to hold tools such as pliers, screwdrivers, screws, nails, and the like. Desirable characteristics of such belts are durability and the capability to hold and store many such tools.

Tool pouches (e.g. bags, aprons, tool belts) worn by construction workers (carpenters, roofers, plumbers, etc.) are designed to hold fasteners such as nails, screws, and small tools such as tape measures and chalk lines. These traditional styled tool pouches such as U.S. Pat. No. 6,390,348 Godshaw, U.S. Pat. No. D316,485 Seber, U.S. Pat. No. D254,759 Rodstein and U.S. Pat. No. D48,2524 Cabrera, consist of one or more tool pouches/pockets and are made from materials such as leather, nylon and canvas. They are typically sewn to be in an easily accessible and open position.

Unfortunately, such an open design is problematic and can allow the contents to spill out. This is very common while being transported in a vehicle and while being worn in a bent-over position. This not only creates a nuisance but can be a safety concern especially while working in an overhead work environment such as a roof, scaffolding, or up a ladder.

There are numerous tool pouches designed to contain the contents of a tool pouch. Some examples may include U.S. Pat. No. 8,991,672 Hassler, U.S. Pat. No. 8,028,872 Hamlin, U.S. Pat. No. D344,630 Doerksen, U.S. Pat. No. 2008/0185414 Conlan, U.S. Pat. No. 2014/0161371 Moreau. However, a need still exists for tool pouch with a closure structure that may be readily removed, readily re-installed and/or readily replaced as desired.

The foregoing and other objectives, features, and advantages of the invention will be more readily understood upon consideration of the following detailed description of the invention, taken in conjunction with the accompanying drawings.

DETAILED DESCRIPTION OF PREFERRED EMBODIMENT

Figure 1:
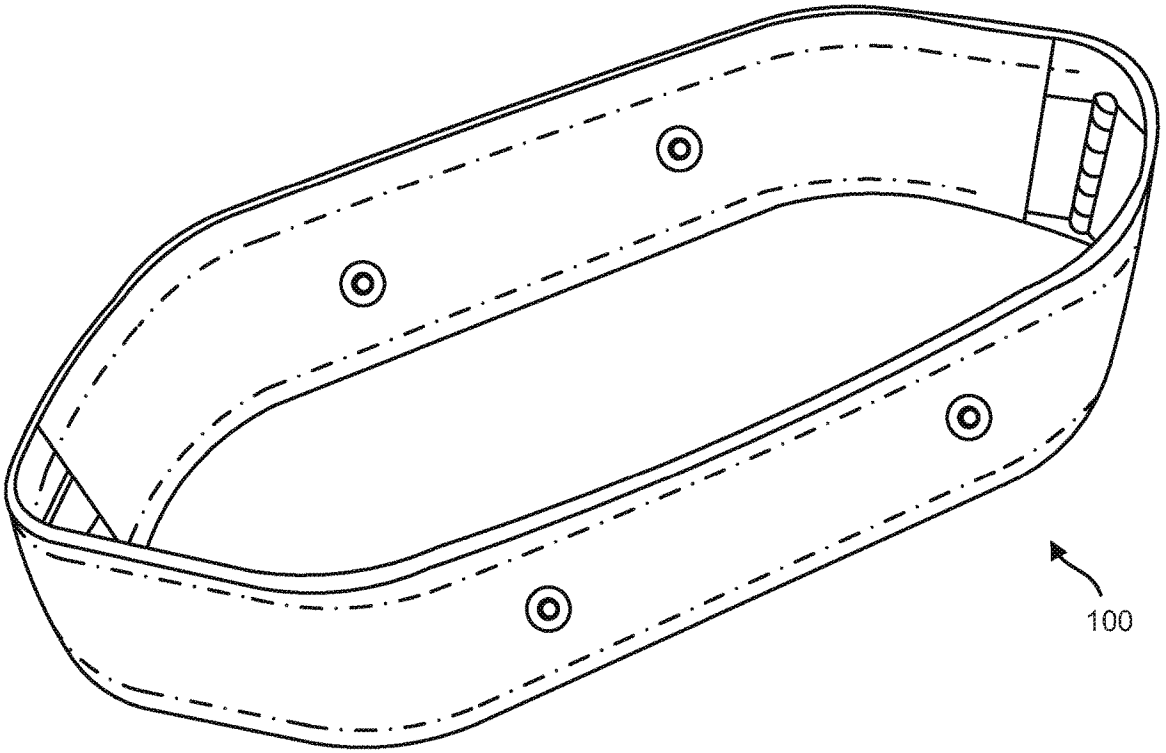
FIG. 1 illustrates a tool pouch closure in the open position.

It is desirable for a tool pouch to have a closure device that may be integrated into an existing tool pouch design without altering the pouch shape or materials used to construct the pouch. To achieve such a closure device and associated structure, flexible frame closures may be used. In particular closures with spring actuated detent hinges attached to flexible spring steel bands are preferably used. This type of closure allows the sides of the pouch to be flexible while open and to close the pouch flat while in the closed position. When the pouch is closed flat it moves the pouch closer to the body. When multiple pouches are attached together the advantages of flat closing pouches are greatly appreciated especially while being stored in a truck box or being worn in tight work areas. Detent spring hinges (otherwise generally referred to as over-center or cam hinges), attached to steel bands or rods may be used.

While the spring hinged closure may be sewn into the tool pouch, it tends to present several problems.

Initially, it is difficult to sew the spring hinged closure into an existing tool pouch/pocket. Tool pouch materials are typically firm saddle type leather or heavy nylon. Tool pouch assemblies typically have several pouches, hammer holders, tape measure holders, etc., and are permanently affixed to the pouch assembly. These obstacles make it difficult to sew a closure into an existing tool pouch without dismantling the tool pouch assembly. These obstacles also create additional undesired rigidity and resistance when trying to move the pouch sides open and closed.

Also, the detent spring hinged closure assembly when opened shortens in length while the tool pouch does not readily shorten in a similar manner. A pouch measured front to back when closed, would use a closure of the same length within that pouch. The closure, when opened, shortens, pulling the hinges inward towards each other as the flexible bands bend and move outward in opposite directions. Typically, the closure is ten to fifteen percent shorter while in the fully opened position than when in the closed position. Unfortunately, the rigidity of typical tool pouches with various holders mounted to the front and rear of the pouch, sewn and riveted together with additional pouches, typically do not cooperate with closure's inward movement. If the closure were sewn around substantially all of the inside perimeter the closure may not function properly. Preferably, the closure is not sewn around the entire inside perimeter.

Also, when a spring hinged frame is sewn into a tool pouch the frame does not have a tendency to stay aligned. Unlike, handbags which are supported equally by both sides of the bag allowing both sides of the handbag to move in unison, tool pouches are supported by one side, typically affixed to either another larger pouch or directly to a belt worn around the waist. They can project outward six to twelve inches away from the waist and when loaded with tools and fasteners can be heavy. When walking or turning the weighted pouch consistently swings to and fro causing the closure assembly to shift within the sewn cover. When the closure's bands and hinges moves out of alignment it causes the hinges to bind and eventually fail.

Tool pouches are used in harsh work environments and at times get damaged. Replacement of a sewn in closure tends to result in at least partial destruction of the integrity of the tool pouch.

The tool pouch closure is designed to not only keep the contents secure while closed, but when in the open position have the strength and flexibility to remain open, absorbing most bangs and bumps that occur in a typical construction environment. Tradesman prefer to be able to have the option to keep the pouch open throughout the work day without the pouch closing unintentionally. Moreover, a tradesman prefers to have the ability to readily replace the closure in the event of its failure and appreciate the option to remove the closure entirely until a situation requires the closure to be reinstalled.

Referring to FIG. 1, a tool pouch closure 100 in the open position prior to being installed into a tool pouch is illustrated.

Figure 2:
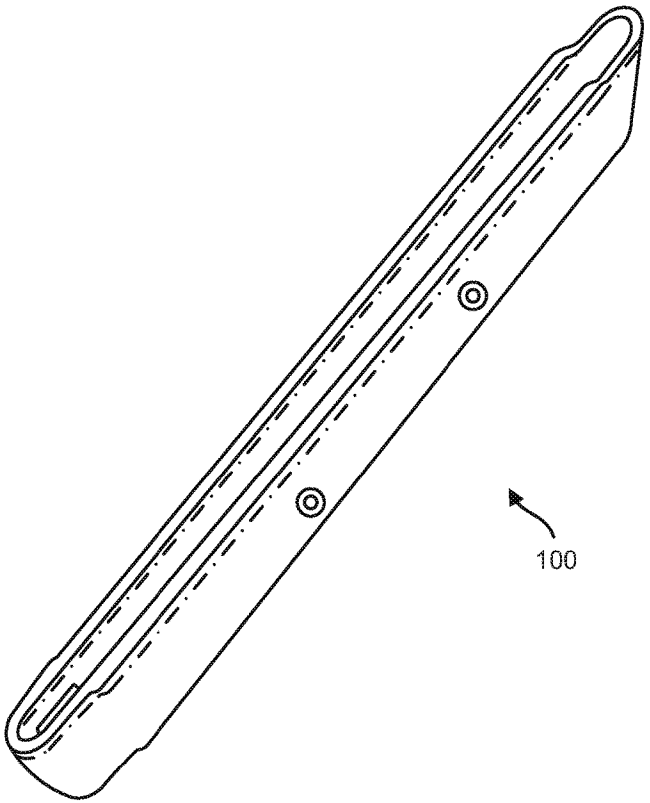
FIG. 2 illustrates a tool pouch closure in the closed position.

Referring to FIG. 2, the tool pouch closure 100 in the closed position prior to being installed into a tool pouch is illustrated.

Figure 3A:
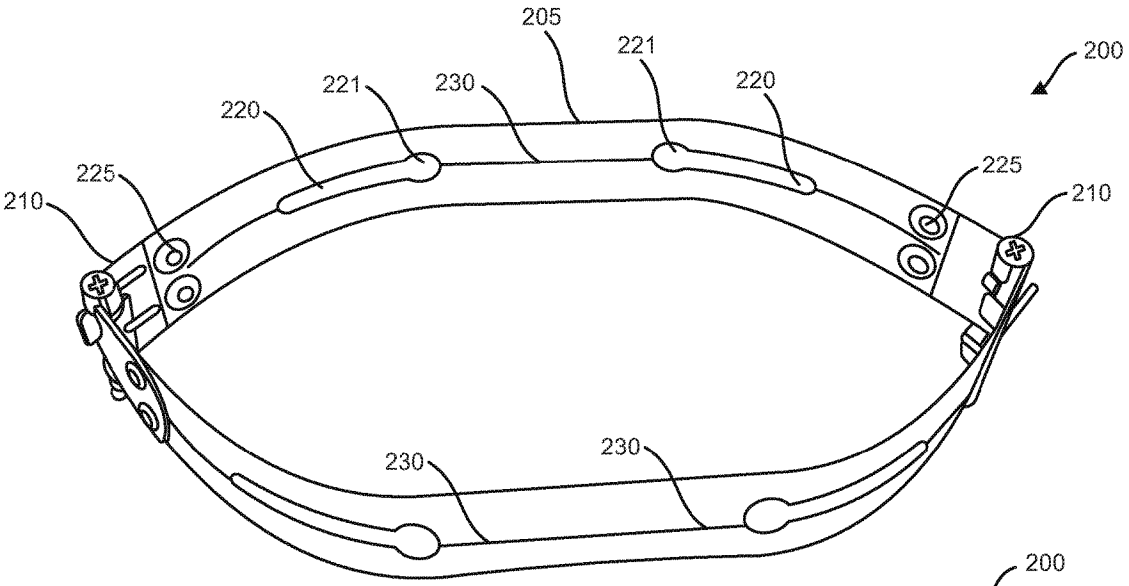
FIGS. 3A and 3B illustrate the tool pouch closure assembled, without the protective sleeve, in the open and closed position.
Figure 3B:
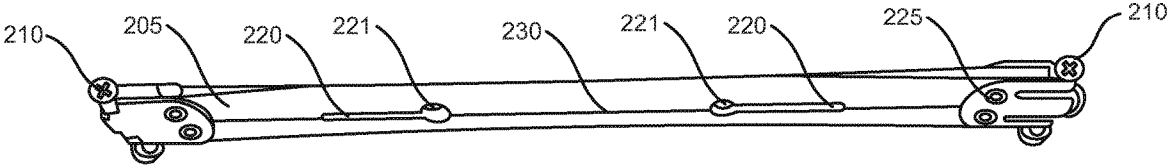

Referring to FIG. 3A and FIG. 3B, the tool pouch closure 100 may include a detent hinged band assembly 200 shown assembled in an open position (see, FIG. 3A) and in closed position (see, FIG. 3B), both without a protective sleeve for illustrative purposes. The closure assembly 200 is comprised of a pair of resilient parallel elongated spring bands 205 attached at their ends by detent spring actuated hinges 210 by fasteners i.e., rivets 225. The spring steel bands 205 are bent longitudinally into a slight V shape adding a defined crease 230 along the length of the bands (preferably along a major portion of the length). This crease 230 and angular shape in the flexible bands 205 adds structure and dimensional stability and adds memory to the bands which assists the bands into a straight, rigid formation when the closure assembly is in the closed position pushing the hinges 210 into a terminal outward position as shown in FIG. 3B. Each band has two opposed keyhole shaped slots 220 positioned approximated one third of the distance in from each hinge 210. The larger circular portion of the keyhole slot 221 allows locations for two eyelets/grommets (one per keyhole) to be installed through both sides of the sleeve/cover and band 205, securing the closure band within the sleeve, thus preventing the closure from shifting within the sleeve. This enlarged, circular location 221 will be further discussed in FIG. 7 and FIG. 8. The balance of the keyhole shaped slot works as a break in the V shaped crease to provide a desired flex location. Reinforcing plates (not shown) may be added between keyholes and at the hinge band connections.

Figure 4:
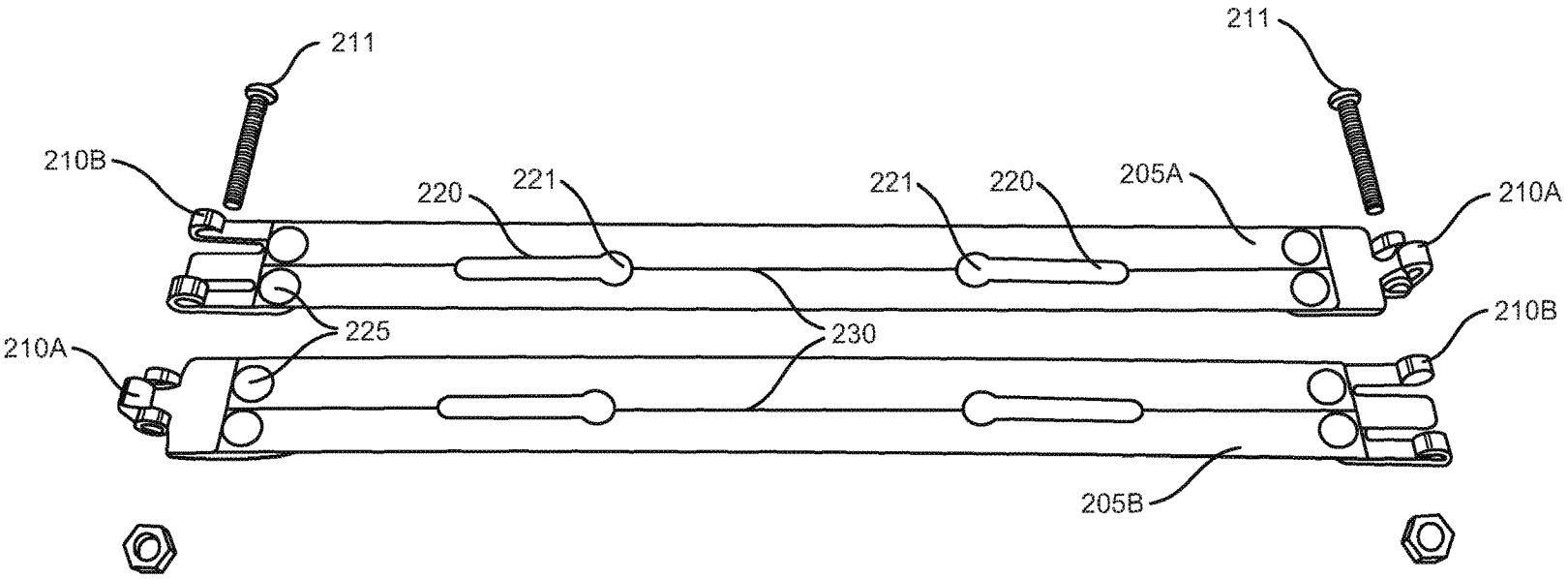
FIG. 4 illustrates the V-shaped bands with keyhole slots fastened to the detent hinges prior to assembly.

Referring to FIG. 4, a pair of opposed detent hinged bands 205A and 205B without the hinge pin (screw) 211 installed is illustrated. Each side of the assembly is comprised of one V shaped band with keyhole slots fastened to the two detent hinge components 210A on one end and 210B on the opposite end. Each completed side is identical. When assembled, hinge 210A from one completed side 205A will join in a hinged relationship with hinge 210B from the other completed side 205B with pivot pins 211 (screws).

Figure 5:
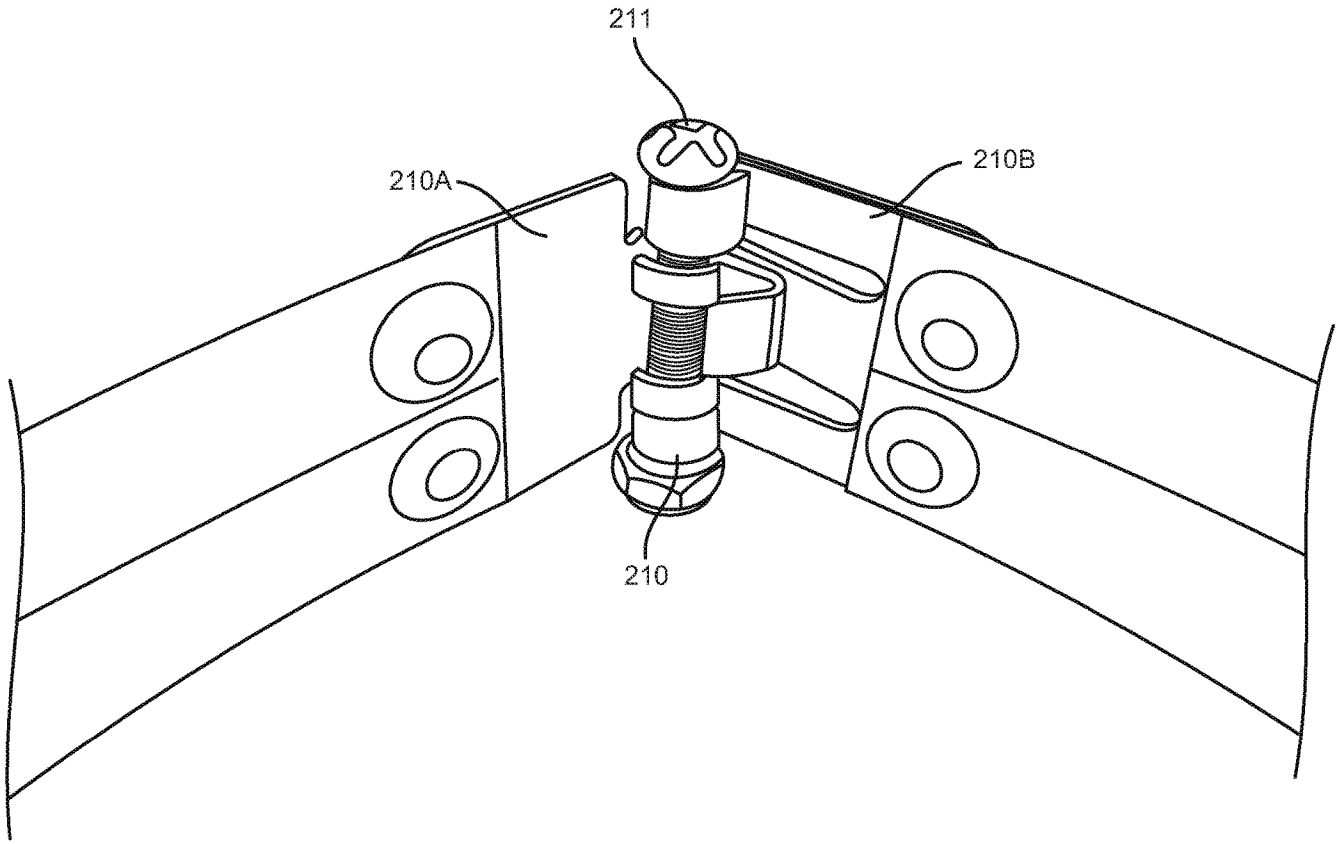
FIG. 5 illustrates the functions of the detent spring actuated hinge progression from an open to a closed position.
Figure 6C:
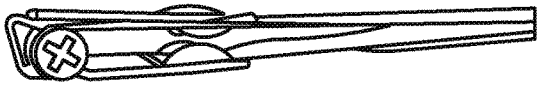
FIGS. 6A-6C illustrate a close up view of an assembled detent hinge in an open position, partially closed/open position, and close position.
Figure 6B:
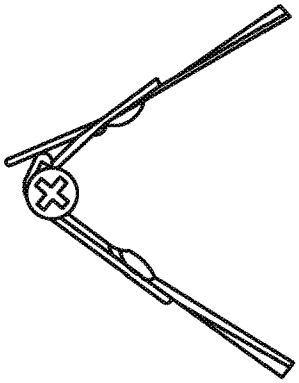
Figure 6A:
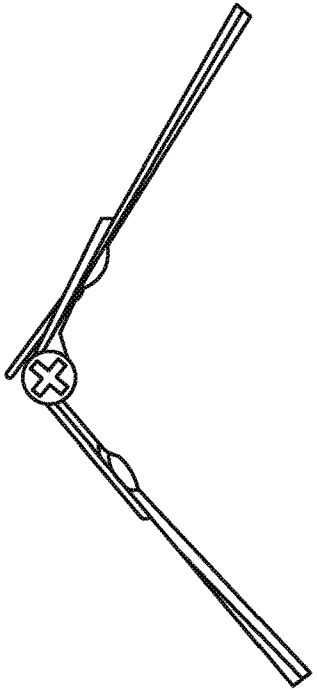

Referring to FIGS. 5-6, the hinge is composed of two sides 210A and 210B joined in a hinged relationship by cooperatively oriented eyelets for receiving a pivot pin or screw 211. One side of the hinge 210A is provided with an aggressive knuckle or cam. The matching side leaf hinge 210B is provided with a resilient tang (leaf spring) that is cooperative with the detent cam. Opening the hinge from the closed position (see FIG. 6C) uses the 210B leaf side's tang (leaf spring) to flex up over the angular cam or knuckle on 210A (see FIG. 6B) and rests on a flat detent relaxing the tang, thus holding the hinge in an open position (see FIG. 6A). To close, the leaf tang again flexes up and over the cam (see FIG. 6B) before relaxing into the closed position (see FIG. 6C). Other configurations of the spring hinge, detent spring hinge, and/or flexible band may be used, as desired.

Figure 7:
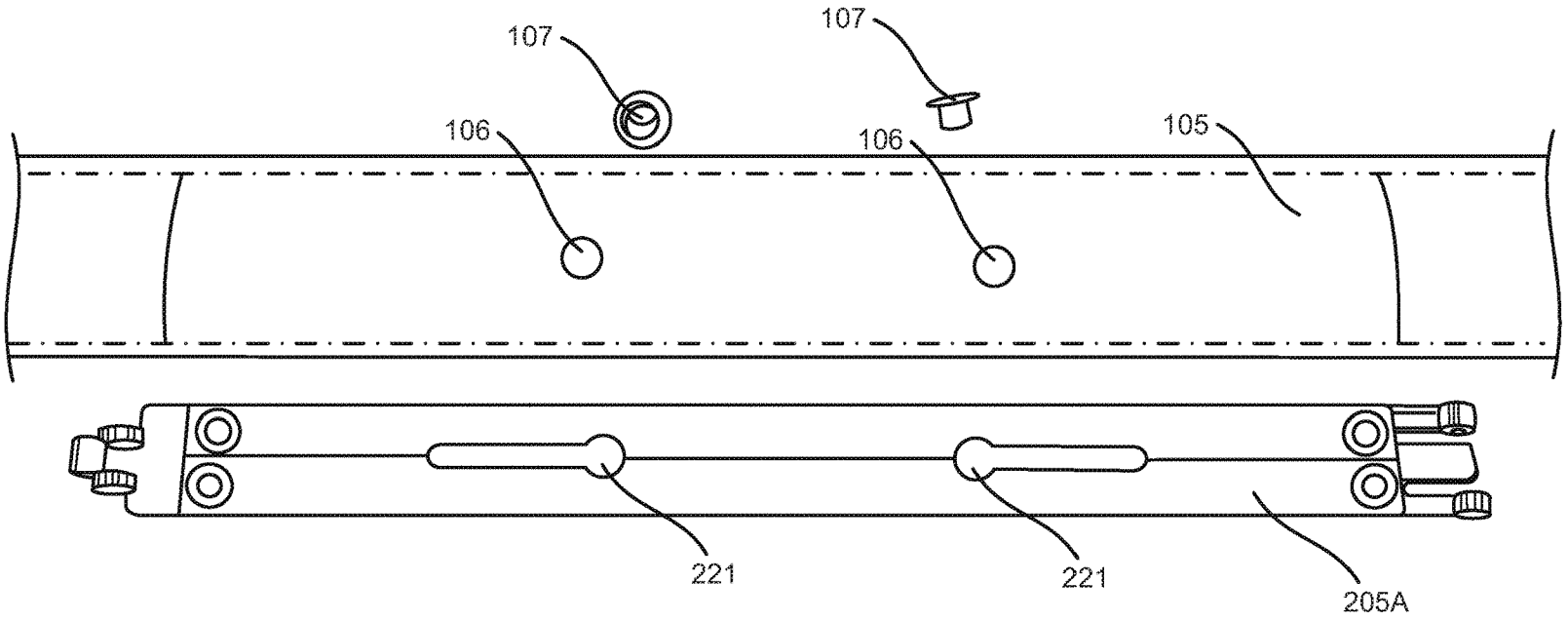
FIG. 7 illustrates one side of tool pouch closure prior to inserting into protective sleeve.

Referring to FIG. 7, an illustration shows one half of the length of the protective sleeve/cover 105 sewn together. The sleeve is comprised of an inside and an outside piece of wear resistant material such as leather or ballistic nylon, stitched together so as to leave a longitudinal pocket the length of the sleeve to insert the detent hinged band assembly. There are two breaks on the interior side of the sleeve at the hinge locations to allow access to the hinges. The sleeve 105 is stitched and ready to receive one detent hinged band i.e. 205A. Each half of the sleeve has two holes 106 punched completely through the inner and outer layer of the sleeve 105. These two holes match up to the enlarged keyhole sections 221.

Figure 8:
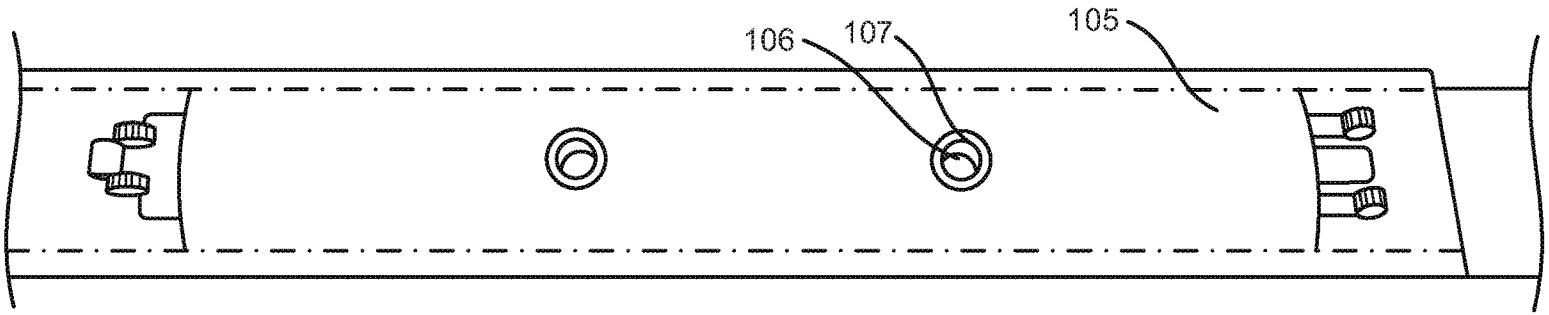
FIG. 8 illustrates one side of the tool pouch closure fastened into the protective sleeve.

Referring to FIG. 8 the hinged band inserted into the sleeve and fastened to the sleeve 105 with two eyelets or grommets 107 is illustrated. The eyelets are inserted through the holes 106 inside of the sleeve proceeding through keyholes 221 and continuing through the outside holes of the sleeve 106 securing the band within the sleeve. This method of fastening the hinged band within the sleeve prevents the detent hinged band assembly from shifting out of alignment within the sleeve 105. Other techniques may likewise be used, as desired.

Figure 9:
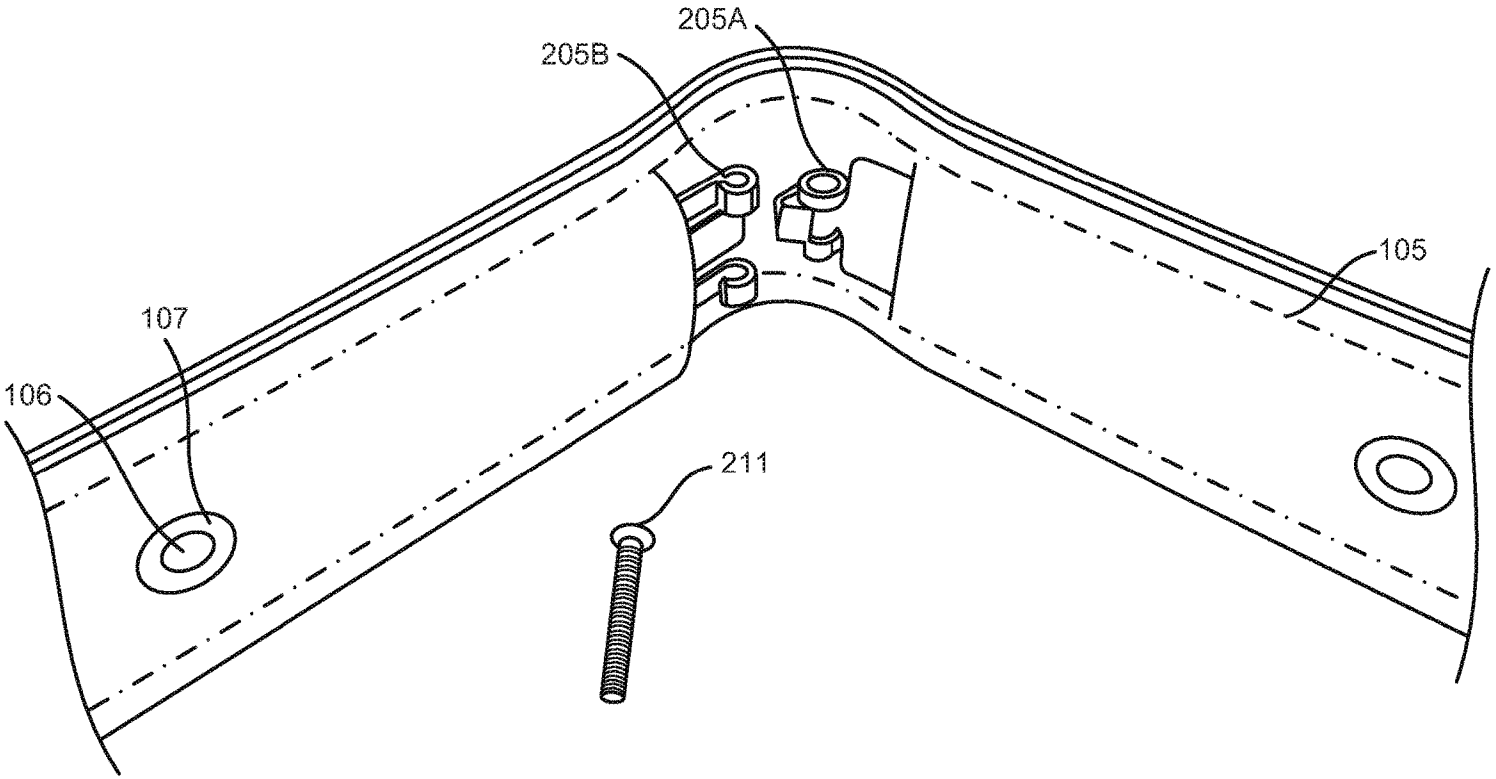
FIG. 9 illustrates tool pouch closure in the protective sleeve prior to hinge pin insertion.

Referring to FIG. 9, the tool pouch closure's sleeve 105 with both hinged bands 205A and 205B inserted and fastened ready to receive the hinge's pivot pin or screw 211 is illustrated. The screw is shown as it is readily installed and removed although a conventional hinge pin may be used. With the detent hinged bands inserted and fastened within the sleeve/cover and both of the hinge pins installed, the tool pouch closure is ready to be installed (see FIG. 1).

Figure 10:
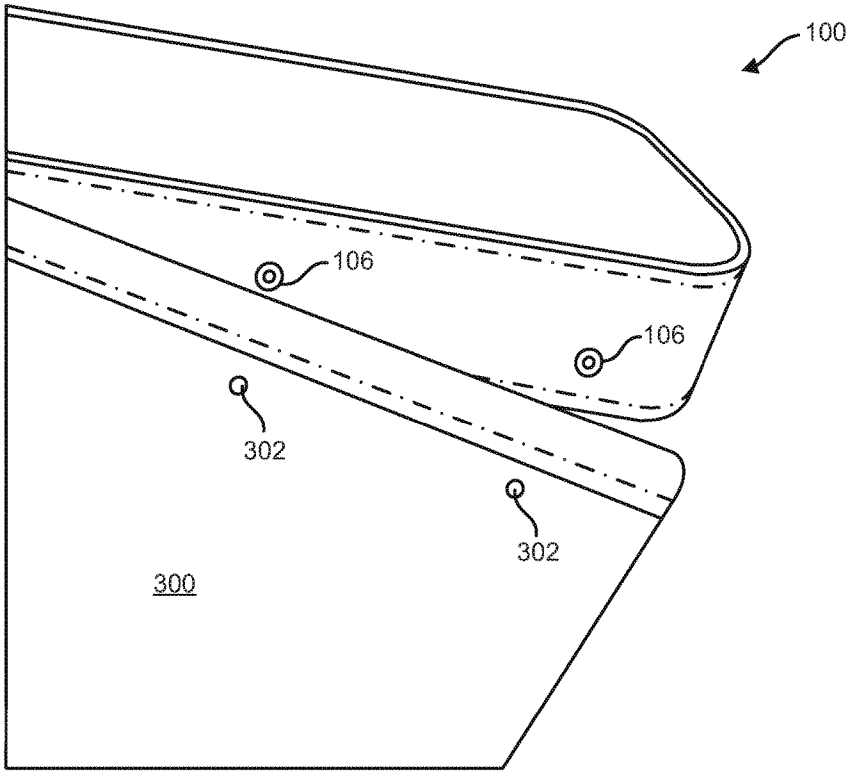
FIG. 10 illustrates a complete tool pouch closure being inserted into a conventional tool pouch.

Referring to FIG. 10, closure 100 may be placed into a pouch 300 with two holes punched 302 through each side of the pouch that align with the mounting holes 106 in the closure.

Figure 11:
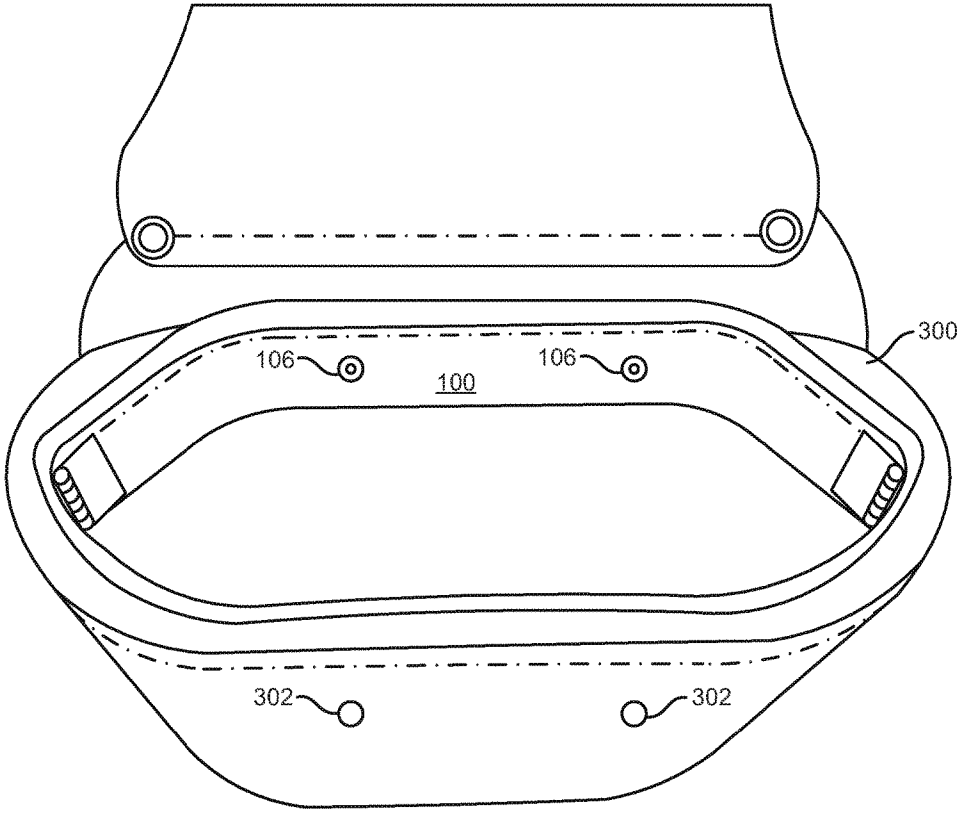
FIG. 11 illustrates a tool pouch closure inserted into a tool pouch prior to securing with fasteners.

Referring to FIG. 11, closure 100 may be placed inside of a tool pouch 300 ready to receive fasteners.

Figure 12:
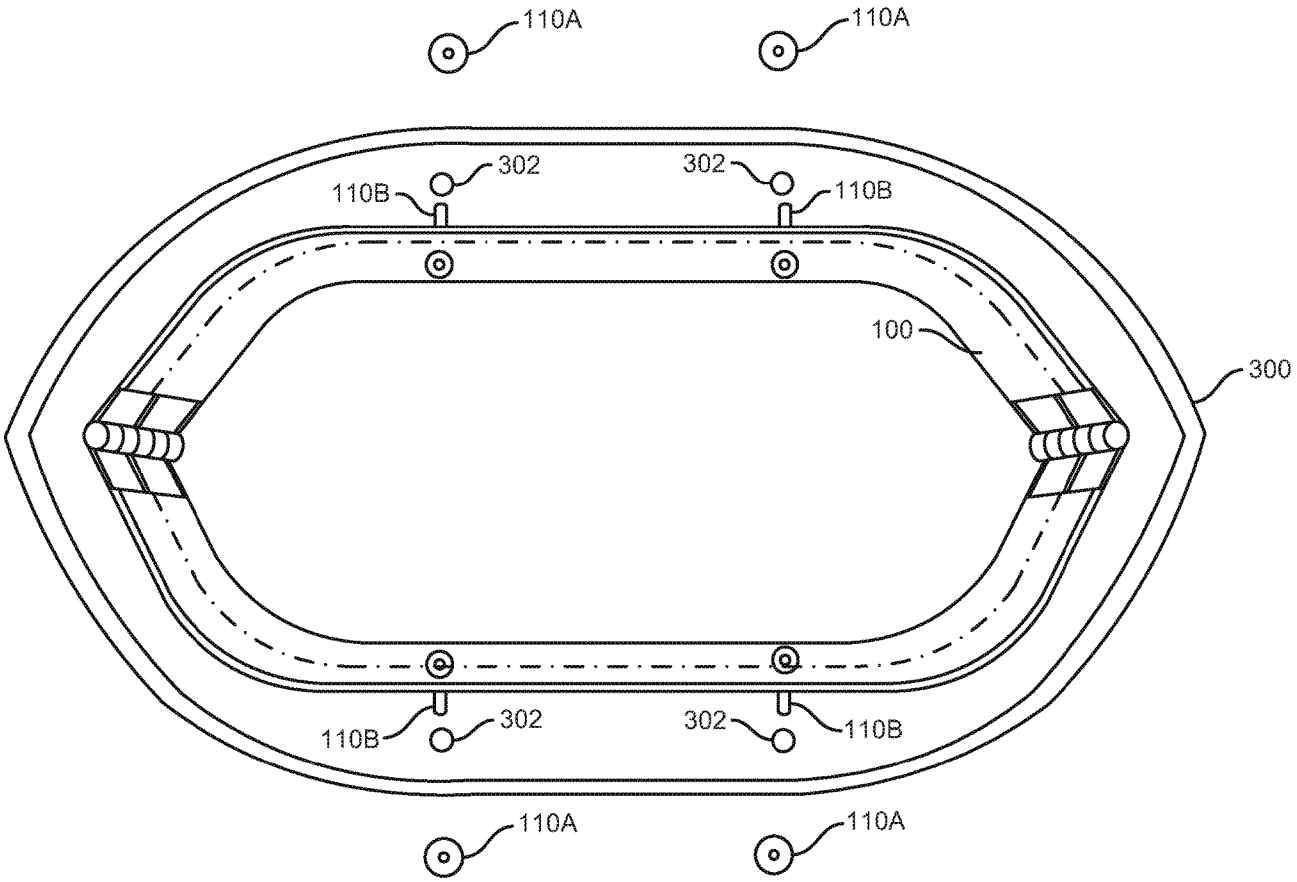
FIG. 12 illustrates a top view of tool pouch, tool pouch closure, and fasteners.

Referring to FIG. 12, an installation or mounting diagram of the tool pouch closure 100 within a tool pouch 300 demonstrating a preferred method of fastening the closure to the sides of the pouch is illustrated. Two part removable fasteners 110A and 110B, i.e. chicago screws, sex bolts are inserted through the closure 100 and through the matching holes in the sides of the pouch 302 and are secured. Other structure may be used to secure the closure within the pouch i.e., hook and loop material sewn to the outside of the sleeve and sewn directly into the pouch, by stitching the closure directly to the pouch. The location of where the tool pouch closure is fastened and/or secured within the pouch may be to the sides of the pouch (preferably the middle third of each opposing side) to allow the energy of the detent spring hinge with spring bands closure to be focused on the middle of each opposing side of the pouch. This allows the balance of the closure, roughly one third of the length of the closure from the front hinge and one third of the length of the closure from the rear hinge, to move more independently of the pouch. This allows the closure's ends to move more freely inward when the pouch is in the open position and outward when in the closed position. Furthermore, when walking or turning, the inward side of the pouch closest to the body tends to follow the movement of the waist or body while the outward side of the pouch furthest away from the body tends to swing to and fro, from front to back due to the inertia generated from the weight of the contents in the pouch. This floating closure design allows the closure's ends to shift from side to side within the pouch allowing the spring bands to absorb this energy reducing the stress placed on the detent hinges.

Figure 13:
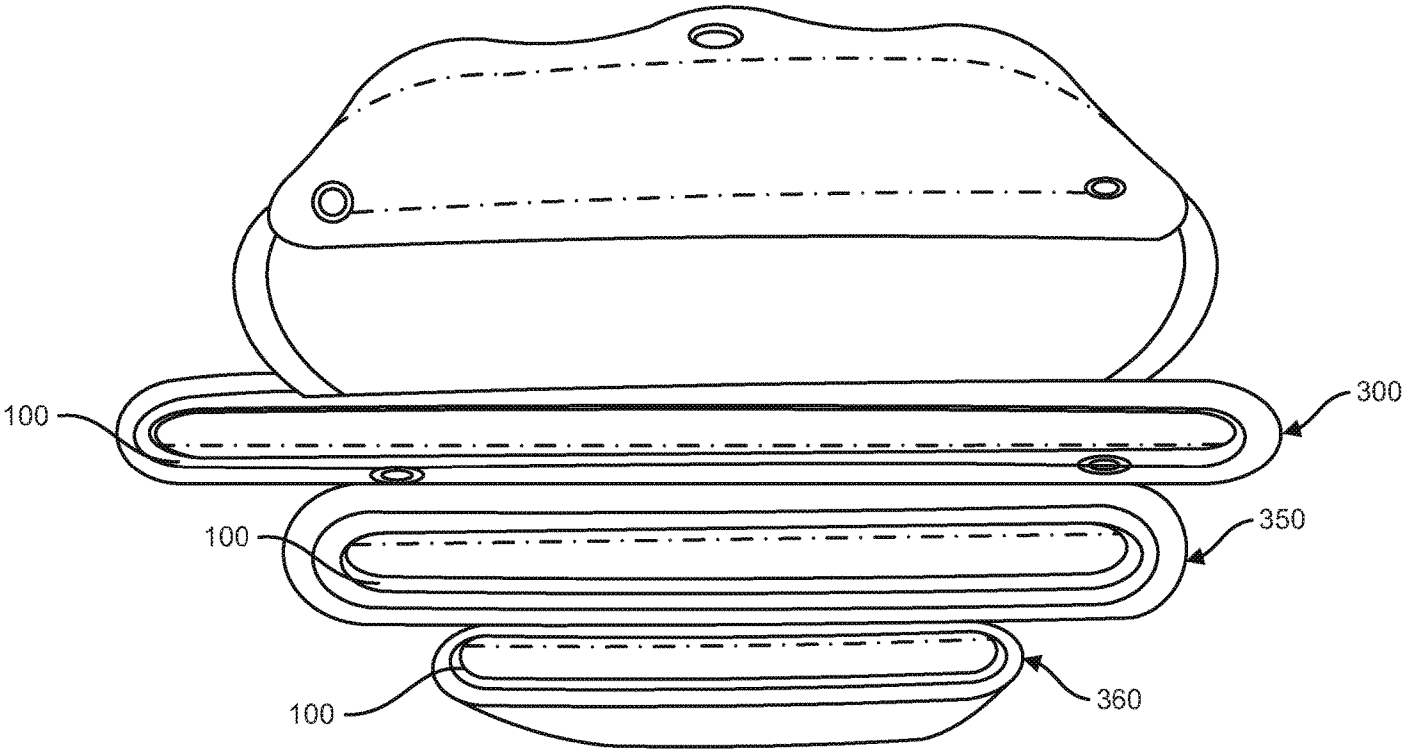
FIG. 13 illustrates a tool pouch assembly in a three pouch configuration with tool pouch closures installed, with all three pouches in the closed position.

Referring to FIG. 13, the tool pouch assembly is illustrated with a three pouch configuration 300, 350 and 360 with the tool pouch closures 100 installed, all in the closed position. This illustrates how the tool pouch closures pull the sides of the pouches together, flattening the pouches and preventing the contents of the pouches from spilling out.

Figure 14:
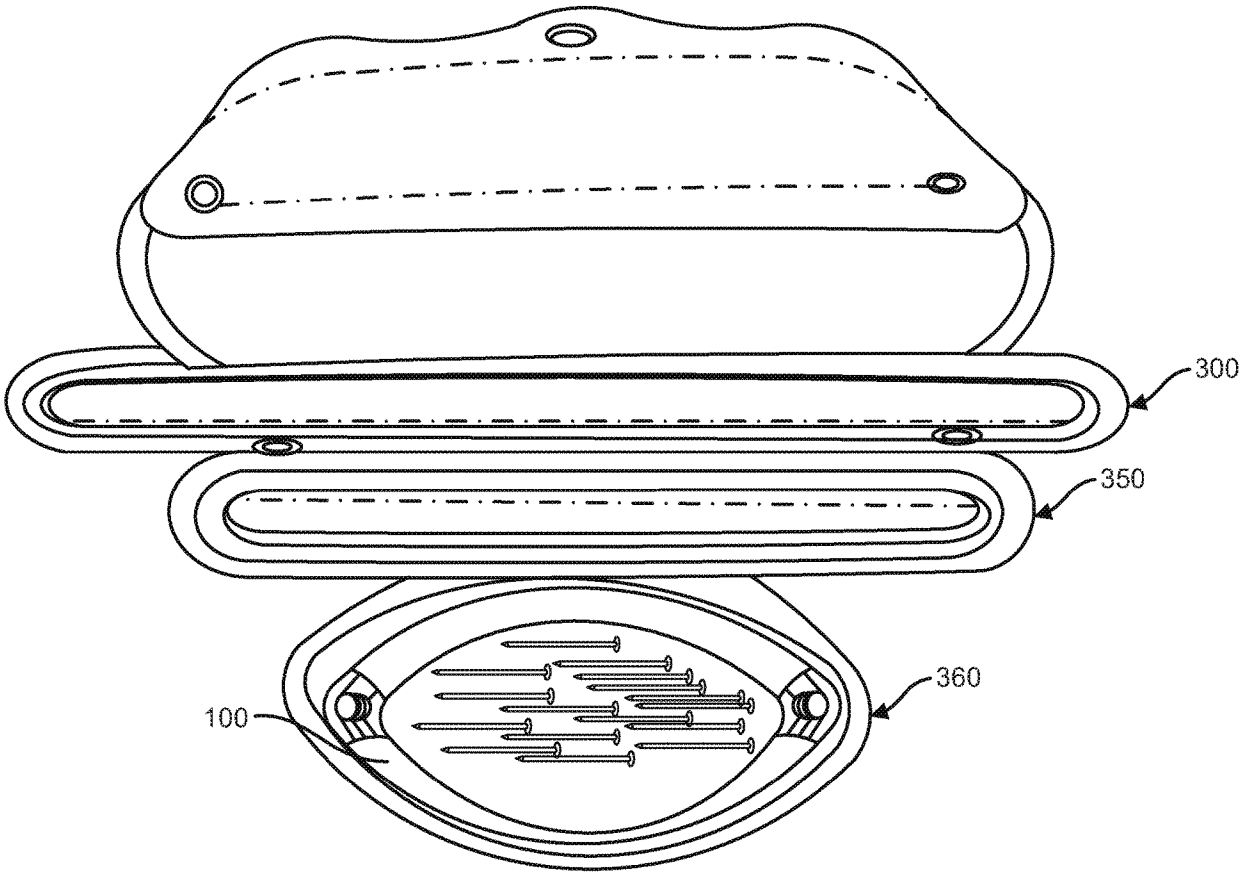
FIG. 14 illustrates a tool pouch assembly in a three pouch configuration with tool pouch closures installed, with only the small pouch in the open position.

Referring to FIG. 14, the tool pouch assembly in a three pouch configuration with closures 100 installed, showing the larger pouch 300, the medium size pouch 350 in the closed position and the small pouch 360 in the open position is illustrated. This illustrates how a tradesman can open and work from the contents of the small pouch 360 thus being more efficient by eliminating access to the items not being used in the other two closed pouches.

Figure 15:
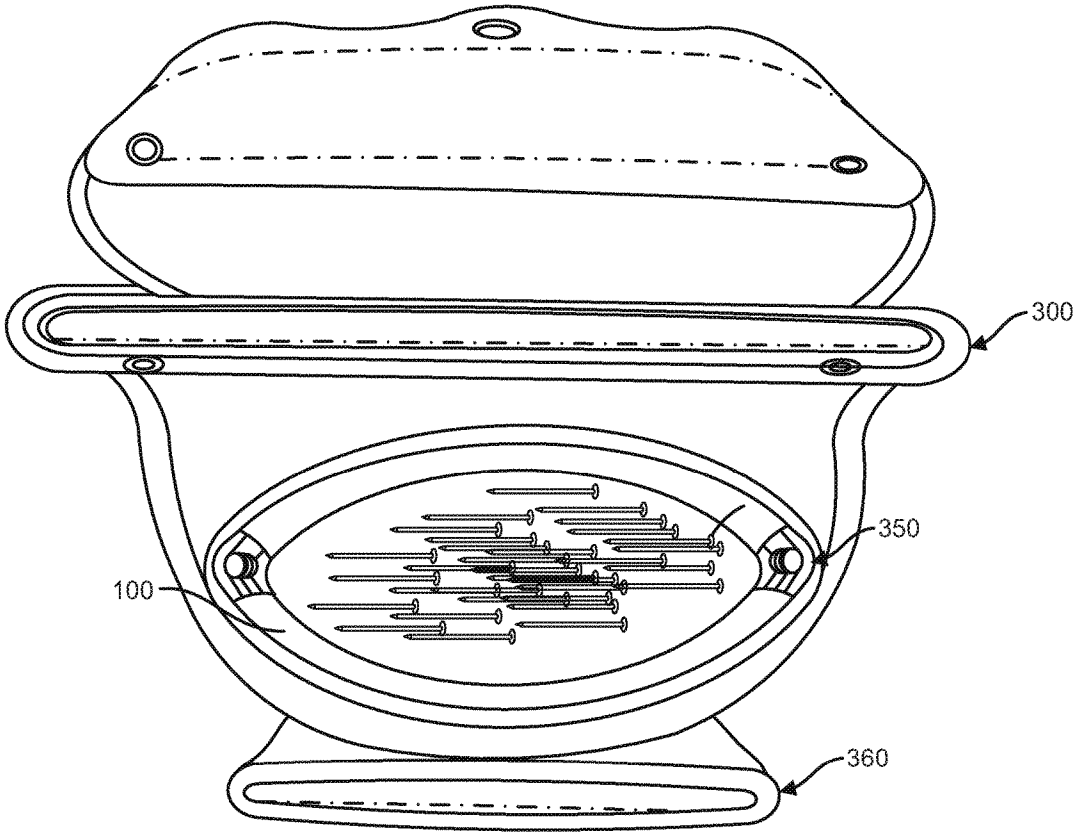
FIG. 15 illustrates a tool pouch assembly in a three pouch configuration with tool pouch closures installed, with only the medium sized pouch in the open position.

Referring to FIG. 15, the tool pouch assembly in a three pouch configuration with closures 100 installed, showing the larger pouch 300, the small pouch 360 in the closed position and the medium sized pouch 350 in the open position is illustrated. This illustrates how a tradesman can open and work from the contents of the medium pouch 350 thus being more efficient by eliminating access to the items not being used in the other two closed pouches.

Figure 16:
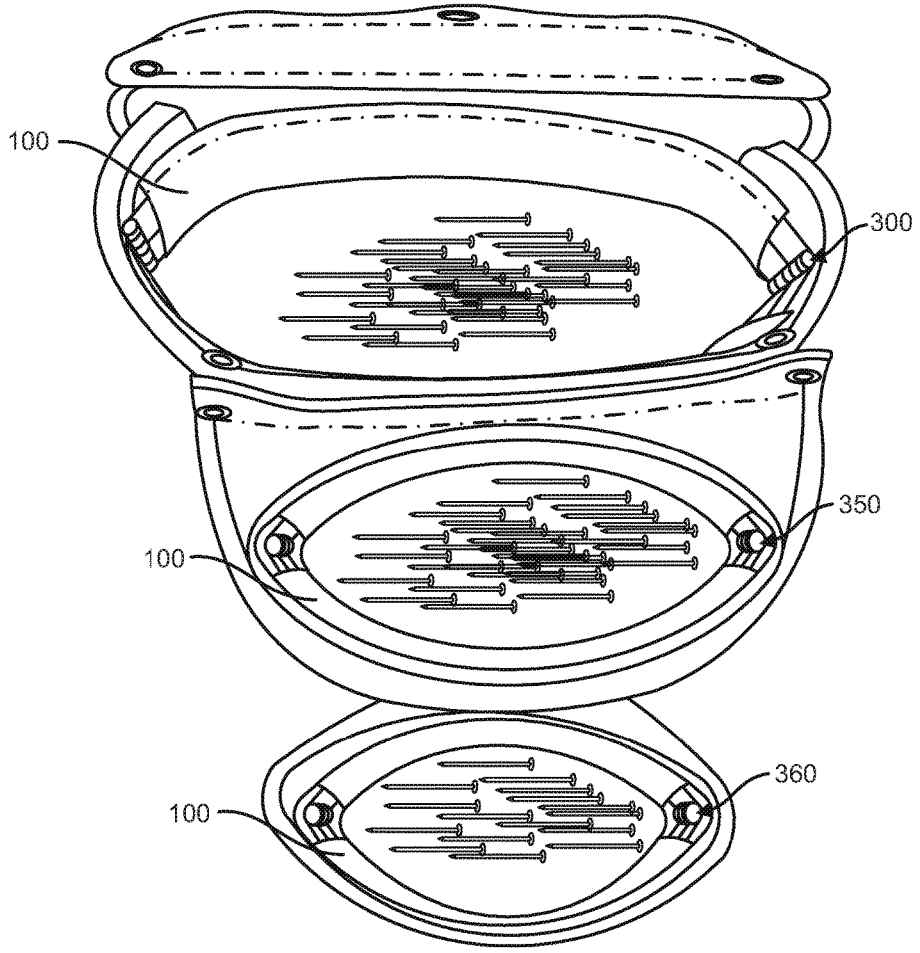
FIG. 16 illustrates a tool pouch assembly in a three pouch configuration with tool pouch closures installed, with all of the pouch closures in the open position.

Referring to FIG. 16, the tool pouch assembly in a three pouch configuration 300, 350 and 360 with closures 100 installed showing all three pouches in the open position allowing full access to the contents of all three pouches is illustrated.

Figure 17:
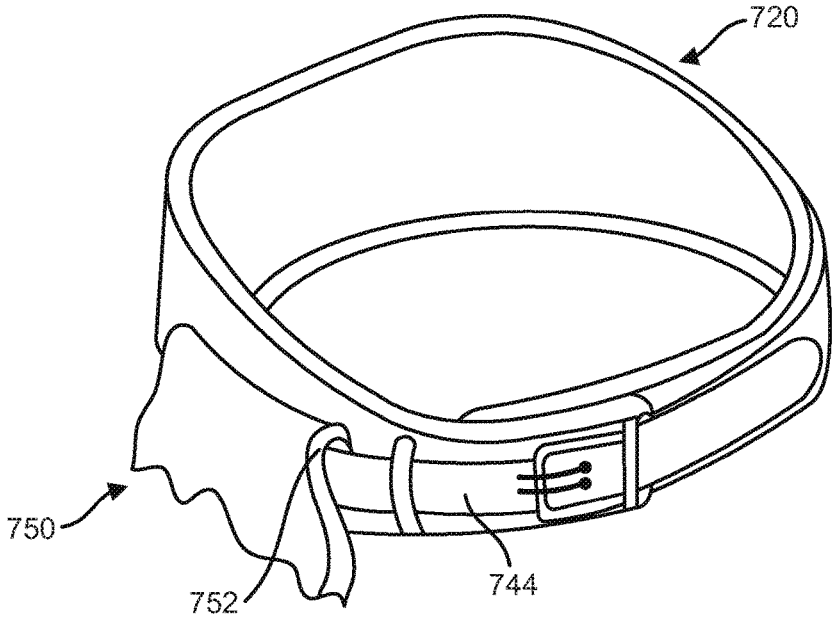
FIG. 17 illustrates a tool belt with a tool pouch attached thereto.

Referring to FIG. 17, a tool belt that is suitable to support the tool pouch(s) comprised of a tool belt assembly 720. A tool pouch 750 that is supported on the strap 744. The pouch 750 may include the pouch noose 752 fitted onto the strap 744. Other interconnections may be used between the pouch 750 and the strap and/or tool belt. It is noted that the tool belt and strap may be integrated components or separate components, as desired.

It is to be understood that the closure assembly, including its cover thereof, may be provided separate from the tool belt and/or the tool pouch. It is to be understood that preferably there are only 2 connections between the closure assembly and the respective side of the tool pouch, with the remainder being not attached to one another.

In general, one or more of the bags may be secured, and one or more of the bags may be open so that the contents therein are readily accessible. Also, the tool bag may be modified to include one bag, two bags, three bags, four bags, or more as desired.

In another embodiment, the spring hinge closure may be included within the opening defining a shot shell bag.

In another embodiment, the spring hinge closure may be included within a tool bag. The tool bag typically has a large central opening (with a spring hinge closure included therein) and a set of various sized pouches around substantially the entire periphery of the tool bag.

In another embodiment, the spring hinge closure may be included within a bucket tool bag. The bucket tool bag typically has an upper portion that is suitable for being supported by the upper rim of the bucket.

As previously described, the closure may be constructed with two parallel elongated spring steel bands attached at their ends by detent spring hinges. The steel bands and hinged assembly is then secured with fasteners into a protective sleeve/cover that is made with a wear resistant material such as leather, ballistic nylon, etc.

As previously described, the bands may be made with a very flexible spring steel that is bent longitudinally into a slight V shape adding a defined crease along the entire length of the center of the bands. This crease in the steel and V shape adds dimensional stability and strength when in the straight-closed position. This shape also adds memory to the steel which helps the bands to remain straight when fully extended even after years of continuous flexing. Each of the two bands has two opposing key hole shaped slots positioned approximately one third of the distance in from each hinge. The larger portion of the keyholes allows locations for two eyelets/grommets (one per keyhole) to be installed through both sides of the sleeve and band, securing the closure band within the sleeve, thus preventing the closure from shifting within the sleeve. The two eyelets per band create four mounting locations in total for the closure assembly (two per side). These four eyelet holes fastened on and through the closure provides locations to mount the closure to the pouch with four fasteners. The balance of the keyhole slot works as a break in the V shaped crease, to provide a desired flex location.

As previously described, the installation of this closure devise can be achieved by punching four small holes through the pouch (two per side) and installing four fasteners such as Chicago screws, rivets, sex bolts, etc. through the closure and sides of the pouch. This design also allows a defective closure to be quickly and easily replaced. When the closure is fastened to the pouch in this manner, it allows the two hinged sides of the closure to move generally independently of the pouch allowing the closure to focus its energy on the sides of the pouch, pulling the middle of the pouch together and towards the body when closed and pushing the middle of the pouch outward and away from the body when opened. This focus on the center portion of the pouch allows the use of typical exterior attachments to the front and rear of the pouch such as plier holders (sheaths), knife and pencil holders, etc. without hindering the function of the closure.

As previously described, the detent spring hinges used in the tool pouch closure are attached to opposite ends of the steel bands with fasteners, i.e. rivets. They may include an aggressive cam and wider, shorter leaves to require a forceful, determined action to open or close the closure. The hinge is composed of two sides joined in a hinged relationship by cooperatively oriented eyelets for receiving a pivot pin or screw. One side of the hinge is provided with an aggressive knuckle or cam. The matching side leaf hinge is provided with a resilient tang that is cooperative with the detent cam. Opening the hinge requires the tang (leaf spring) to flex up over the angular cam or knuckle and rest on a flat detent, relaxing the tang thus holding the hinge in an open position. To close, the leaf tang again flexes up and over the cam before relaxing into the closed position.

It is to be understood the claims are not limited to the precise configuration and components illustrated above. Various modifications, changes and variations may be made in the arrangement, operation and details of the systems, methods, and apparatus described herein without departing from the scope of the claims.

I claim:

1. A tool pouch assembly, comprising:

a flexible tool pouch having two opposing interior surfaces;

a spring hinged closure that includes a first side and a second side, wherein the first side and the second side are movable between a first position and a second position, and wherein the first side and the second side are to close the top portion of the tool pouch when in the first position and open a top portion of the tool pouch when in the second position;

a first protective sleeve that covers the first side of the spring hinged closure; and a second protective sleeve that covers the second side of the spring hinged closure in which:

an exterior surface of said first protective sleeve faces one of the two opposing interior surfaces of the first pouch and an exterior surface of said second protective sleeve faces the other of the two opposing interior surfaces of the first pouch;

said first side of said first spring hinged closure is secured to a first side of said tool pouch; and said second side of said first spring hinged closure is secured to a second side of said tool pouch.

2. A tool pouch assembly, comprising:

a flexible tool pouch having first and second opposing sides;

a spring hinged closure that includes a first side and a second side, wherein the first side of the spring hinged closure and the second side of the spring hinged closure are movable relative to each other between a first position and a second position, and wherein the first side of the spring hinged closure and the second side of the spring hinged closure are configured to close the top portion of the tool pouch when in the first position and to open a top portion of the tool pouch when in the second position;

a first protective sleeve that covers the first side of the spring hinged closure; and a second protective sleeve that covers the second side of the spring hinged closure in which:

an exterior surface of said first protective sleeve faces one of the two opposing sides of the first pouch and an exterior surface of said second protective sleeve faces the other of the two opposing sides of the first pouch;

said first side of said first spring hinged closure is secured to the first side of said tool pouch; and said second side of said first spring hinged closure is secured to the second side of said tool pouch.

3. A tool pouch assembly, comprising:

a flexible tool pouch having first and second opposing sides;

a spring hinged closure that includes a first side and a second side, wherein the first side of the spring hinged closure and the second side of the spring hinged closure are movable relative to each other between a first stable position and a second stable position, and wherein the first side of the spring hinged closure and the second side of the spring hinged closure are configured to close the top portion of the tool pouch when in the first stable position and to open a top portion of the tool pouch when in the second stable position;

a protective sleeve covering the spring hinge closure, the protective sleeve formed from a fabric separate from the tool pouch and substantially surrounding the spring hinge closure;

the first side of the spring hinged closure together with the surrounding protective sleeve being attached to the first side of the tool pouch and the second side of the spring hinged closure together with the surrounding protective sleeve being attached to the second side of the tool pouch.

4. A tool pouch assembly, comprising:

a flexible tool pouch having two opposing interior surfaces;

a spring hinged closure that includes a first side and a second side, wherein the first side and the second side are movable between a first position and a second position, and wherein the first side and the second side are to close the top portion of the tool pouch when in the first position and open a top portion of the tool pouch when in the second position;

a first protective sleeve that covers the first side of the spring hinged closure; and a second protective sleeve that covers the second side of the spring hinged closure in which:

said first side of said spring hinged closure defines a first pair of openings therein positioned along the length of said first side of said first spring hinged closure, where said second side of said first spring hinged closure defines a second pair of openings therein positioned along the length of said second side of said first spring hinged closure, where an exterior surface of said first protective sleeve faces one of the two opposing interior surfaces of the first pouch and an exterior surface of said second protective sleeve faces the other of the two opposing interior surfaces of the first pouch;

said first side of said first spring hinged closure is secured to a first side of said tool pouch; and said second side of said first spring hinged closure is secured to a second side of said tool pouch.

5. The tool pouch assembly of claim 4, wherein the spring hinged closure includes:

a first cam and a first tang that act cooperatively with each other; and a second cam and a second tang that act cooperatively with each other.

6. The tool pouch assembly of claim 4, wherein the first side of the spring hinged closure comprises a first elongated band and the second side of the spring hinged closure comprises a second elongated band, and wherein the closure assembly further comprises:

a first spring hinge attached to a first end of the first elongated band and a first end of the second elongated band; and a second spring hinge attached to a second end of the first elongated band, opposite to the first end of the first elongated band, and a second end of the second elongated band, opposite to the first end of the second elongated band, wherein the first spring hinge and the second spring hinge are to hold the first side and the second side in the first position when the top portion of the tool pouch is closed, and wherein the first spring hinge and the second spring hinge are to hold the first side and the second side in the second position when the top portion of the tool pouch is open.

7. The tool pouch assembly of claim 6, wherein a portion of the first side of the spring hinged closure and a portion of the second side of the spring hinged closure are uncovered by the first protective sleeve and the second protective sleeve to expose the first spring hinge and the second spring hinge.

8. The tool pouch assembly of claim 6, wherein:

the first spring hinge includes a tang and a cam, wherein the tang of the first spring hinge rests on a flat portion of the cam of the first spring hinge when the top portion of the tool pouch is open and holds the first side and the second side in the second position; and the second spring hinge includes a tang and a cam, wherein the tang of the second spring hinge rests on a flat portion of the cam of the second spring hinge when the top portion of the tool pouch is open and further holds the first side and the second side in the second position.

9. The tool pouch assembly of claim 8, wherein:

the tang of the first spring hinge rests against a second flat portion of the cam of the first spring hinge when the top portion of the tool pouch is closed and holds the first and second side in the first position; and the tang of the second spring hinge rests against a second flat portion of the cam of the first spring hinge when the top portion of the tool pouch is closed and further holds the first side and the second side in the first position.

10. The tool pouch assembly of claim 4, wherein:

the first side of the spring hinged closure is detachably secured to a first side of the tool pouch via the first pair of openings; and the second side of the spring hinged closure is detachably secured to a second side of the tool pouch via the second pair of openings.

11. The tool pouch assembly of claim 10, wherein:

the first side of the spring hinged closure is detachably secured to the first side of the tool pouch via a first pair of fasteners inserted into the first pair of openings; and the second side of the spring hinged closure is detachably secured to the second side of the tool pouch via a second pair of fasteners inserted into the second pair of openings.

12. The tool pouch assembly of claim 4, wherein the spring hinged closure includes detent hinges.

13. The tool pouch assembly of claim 4, wherein the first side and the second side are straight when the first side and the second side are in the first position, and wherein the first side bends away from the second side and the second side bends away from the first side when the first side and the second side are in the second position.

14. The tool pouch assembly of claim 4 wherein said first side includes a first longitudinal crease and said second side includes a second longitudinal crease.

15. The tool pouch assembly of claim 4 wherein said first pair of openings comprises a first pair of slots, said second pair of openings includes a second pair of slots, said first longitudinal crease extends on both sides of said first pair of slots, and said second longitudinal crease extends on both side of said second pair of slots.

16. The tool pouch assembly of claim 4 wherein said first spring hinged closure is comprised of a spring actuated detent hinge attached to steel bands.

17. The tool pouch assembly of claim 16 wherein said spring hinged closure is substantially planar when in said first position.

18. The tool pouch assembly of claim 4 wherein said first protective sleeve includes a first break proximate a hinge of said first spring hinged closure and said second protective sleeve includes a second break proximate said hinge of said first spring hinged closure.

19. The tool pouch assembly of claim 4 wherein said first spring hinged closure is readily removable from said first pouch.

20. The tool pouch assembly of claim 4 wherein said first pair of openings comprises a first pair of slots and said second pair of openings includes a second pair of slots.

* * * * *